US006126469A

United States Patent [19]

Yamaguchi

[11] Patent Number: 6,126,469

[45] Date of Patent: Oct. 3, 2000

[54] AUTOMATIC DOOR PANEL-TO-BODY TRIM PANEL ELECTRICAL CONNECTOR WITH LEVER

[75] Inventor: Noboru Yamaguchi, Shizuoka, Japan

[73] Assignee: Yazaki Corporation, Tokyo, Japan

[21] Appl. No.: 08/956,648

[22] Filed: Oct. 23, 1997

[30] Foreign Application Priority Data

Oct. 23, 1996 [JP] Japan ..... 8-280767

[51] Int. Cl.[7] ..... H01R 13/62

[52] U.S. Cl. ..... 439/310

[58] Field of Search ..... 439/34, 157, 310, 439/246, 247, 248, 252, 555–557

[56] References Cited

U.S. PATENT DOCUMENTS 5,391,086 2/1995 Woller et al. ..... 439/157

5,651,683 7/1997 Shimamura et al. ..... 439/34

FOREIGN PATENT DOCUMENTS 8-83645 3/1996 Japan .

*Primary Examiner*—Khiem Nguyen

*Assistant Examiner*—Brian S. Webb

*Attorney, Agent, or Firm*—Armstrong, Westerman, Hattori, McLelan & Naughton

[57] ABSTRACT

A connector connecting structure is provided. In this connector connecting structure, a door trim panel is joined to a door inner panel, and a first connector having following pins is engaged with a mating second connector with ease by virtue of a lever having slots for receiving the following pins. The first connector is connected to the mating second connector by virtue of the rotating operation of the lever. The door trim panel has a bracket to which the first connector is slidably provided and the lever is rotatably provided. The mating second connector and a pressure contact wall having a hook for the lever are provided to the door inner panel. The first and second panels are joined in the horizontal direction so as to rotate the lever and engage the first connector with the mating second connector.

6 Claims, 4 Drawing Sheets

AUTOMATIC DOOR PANEL-TO-BODY TRIM PANEL ELECTRICAL CONNECTOR WITH LEVER

BACKGROUND OF THE INVENTION

1. Field of the Invention

The present invention relates to a connector connecting structure for attaching a door trim panel to an inner door panel and engaging a male connector with a female connector with ease by virtue of a lever.

2. Related Art

FIG. 6 shows a conventional connector connecting structure disclosed in Japanese Patent Application Laid-Open No. 8-83645.

In this structure, a male connector 41 can be easily engaged with a female connector 42 by virtue of a lever 43. A pair of following pins 44 protrude from the male connector 41. The female connector 42 has guide slots 45 for receiving the following pins 44, and a supporting shaft 46 for supporting the lever 43. The lever 43 has bearing holes 47 for bearing the supporting shaft 46, and slide slots 48 for receiving the following pins 44.

The supporting shaft 46 is engaged with the bearing holes 47 so that the lever 43 is pivotally held by the female connector 42. The male connector 41 is initially engaged with the female connector 42, so that the following pins 44 can be engaged with the guide slots 45 and the slide slots 48. The lever 43 is pressed forward (toward the male connector) so as to push the following pins 44 into the slide slots 48 and move them along the guide slots 45. By doing so, the male and female connectors 41 and 42 are engaged with each other.

In the conventional structure, however, the operator needs to hold the male connector 41 and the female connector 42 with both hands during the engagement operation. Especially when one of the connectors 41 and 42 is connected to a large member such as a door trim panel 2 or a door inner panel 1 of an automobile as shown in FIG. 7, the operator has to engage the connectors blindly through service holes 49. This results in poor efficiency in the engagement operation.

In FIG. 7, a wire harness 50 is provided inside the door inner panel 1. One end of the wire harness 50 is connected to a connector 52 via a grommet 51. The connector 52 is connected to an electrical connection box 54 on the side of the main body 53. The other end of the wire harness 50 is connected to a switch unit 55 on the side of the door trim panel 2. Switches 56 on the switch unit 55 are pressed so as to open and close a power window, and to move rearview mirrors.

SUMMARY OF THE INVENTION

The object of the present invention is to provide a connector connection structure for efficiently connecting a circuit on the door trim panel side, such as a switch unit, to a circuit on the door inner panel side using a lever with less force and effort.

To achieve the above object, the present invention provides a connector connecting structure for engaging a first connector having following pins with a mating second connector by virtue of the pivotally operation of a lever having slide slots for receiving the following pins. This connector connecting structure has a bracket on the side of a first panel. The bracket is provided with the first connector which is slidable in the bracket and the lever which is pivotally mounted thereon. The mating second connector and a pressure contact wall for the lever are provided on the side of a second panel. The pressure contact wall may be provided with a hook unit for hooking the lever. The first connector is provided slidable in the horizontal direction, while the pressure contact wall extends perpendicularly when respect to the first connector. The first panel is laterally brought into contact with the second panel. Here, the lever can pivot freely, and both of the connectors can be engaged with each other.

In this connector connecting structure, when the first panel and the second panel are joined to each other, the pressure contact wall presses and pivot the lever. By doing so, the first connector moves toward the mating second connector along the bracket. The first connector and mating second connector can be surely engaged with each other by the resultant force of the pressure of the first panel against the second panel and the forward thrust of the first connector generated by the pressed lever. Here, the lever is hooked by the hook unit. If the first panel is separated from the second panel, the hook unit pushes the lever to pivot in the counter clockwise direction, so that the first connector and mating second connector can be separated from each other.

The above and other objects and features of the present invention will be more apparent from the following description taken in conjunction with the accompanying drawings.

DESCRIPTION OF THE PREFERRED EMBODIMENTS

The following is a detailed description of an embodiment of the present invention with reference to the attached drawings.

FIGS. 1 to 5 show the embodiment of the connector connecting structure of the present invention.

Figure 1:
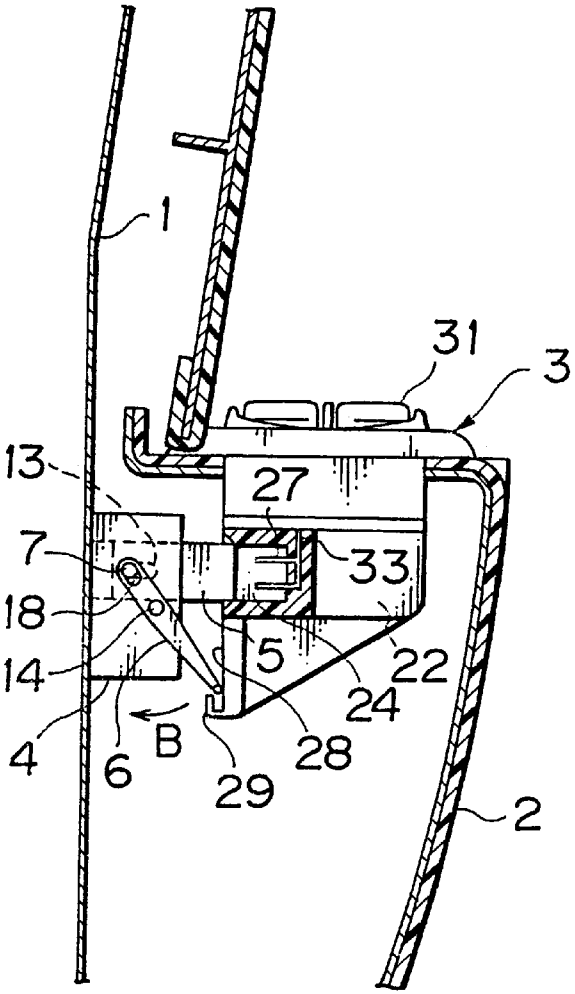
FIG. 1 is a side view of a connector connecting structure of the present invention.

FIG. 1 shows a door inner panel 1, a door trim panel 2, and a switch unit 3 provided on the door trim panel 2.

The door inner panel 1 is provided with a bracket 4. A male connector 5 of the harness is slidable with respect to the bracket 4 in the traverse (horizontal) direction. A lever 6 is pivotally mounted on the bracket 4, and the root of the lever 6 engages short cylindrical following pins 7 of the male connector 5.

Figure 4:
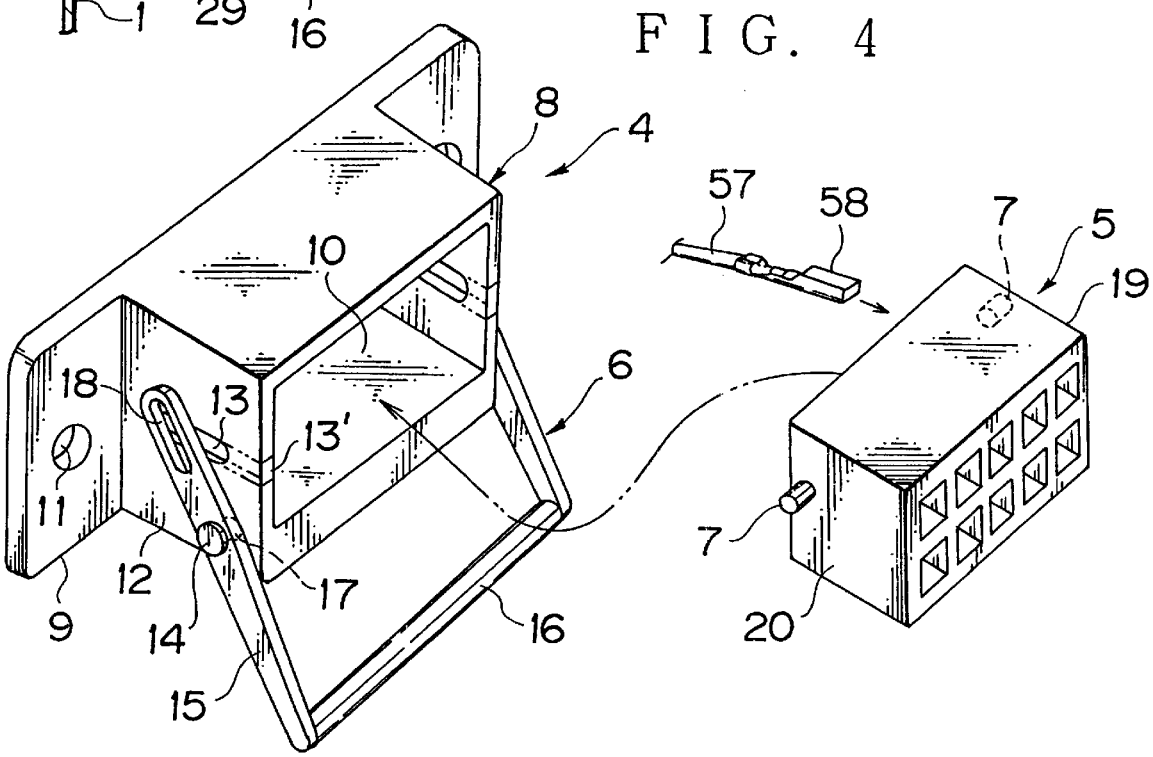
FIG. 4 is an exploded perspective view of a male connector to be received by a bracket.

As shown in FIG. 4, the bracket 4 includes a box-like frame wall 8 and flanges 9 protruding laterally from the frame wall 8. The male connector 5 is slidably held in a space 10 inside the frame wall 8. The flanges 9 are fixed onto the door inner panel 1 by inserting a bolt (not shown) into bolt holes 11. A pair of long guide slots 13 for receiving the following pins 7 are horizontally provided in the middle of the side walls 12 of the frame wall 8. Below the long guide slots 13, the lever 6 is rotatably supported by supporting shafts 14. The long guide slots 13 may be cut slits as shown by a chain line 13' in FIG. 4.

The lever 6 takes the form of a rectangle minus one side, including two side arms 15 and one connecting arm for connecting the two side arms 15. An engaging hole 17 is formed in the middle of each side arm 15, and a straight slide slot 18 for receiving the respective following pins is formed at the root portion of each side arm 15. Each of the slide slots 18 always crosses the corresponding guide slot 13 when moving the lever 6 pivotally. The following pins 7 of the male connector 5 engage the slide slots 18 and are held slidably along the guide slots 13 in the horizontal direction. The length between the supporting shaft 14 and the connecting arm 16 is longer than the length between the supporting shaft 14 and the following pins 7 (slide slots 18), so that the lever 6 can have leverage.

A female terminal 58 is inserted from the rear side of the male connector 5. Wires 57 connected to the female terminal 58 are introduced from the inside of the frame wall 8 toward the door inner panel 1. The wires 57 constitute a wire harness. The following pins 7 protrude from side walls 20 of the male connector housing 19. The male connector housing 19 at a rear portion thereof and the female terminal 58 constitute the male connector.

Figure 5:
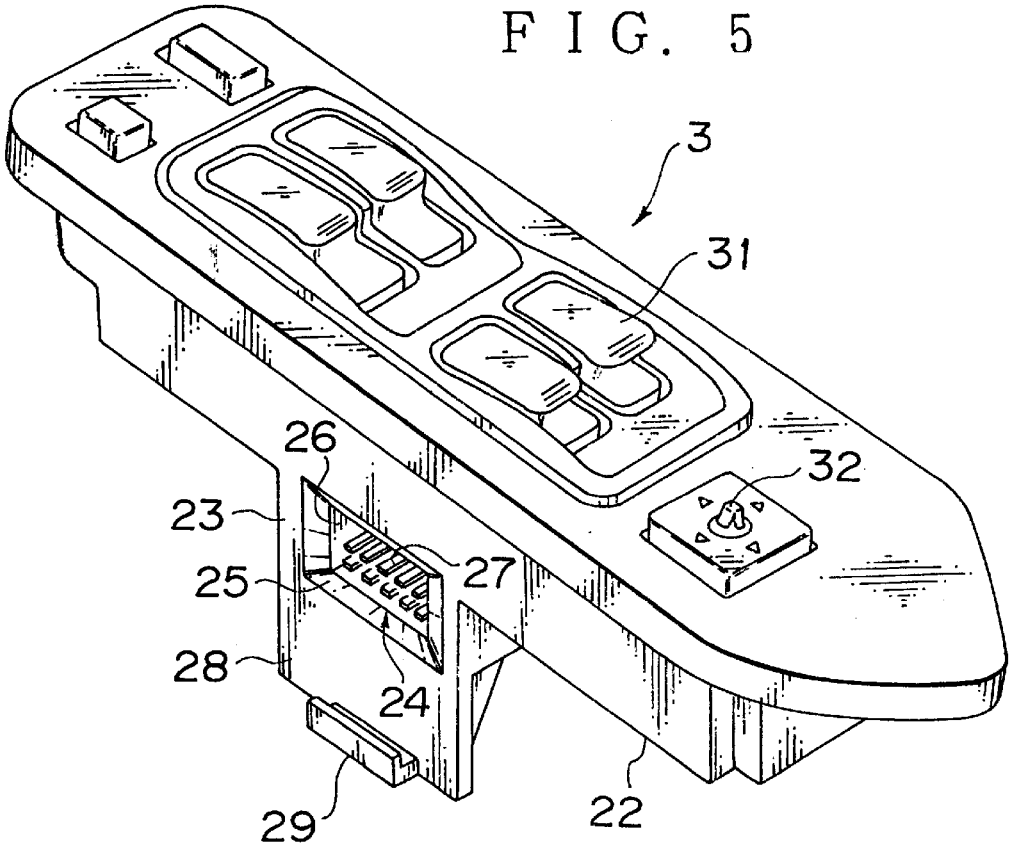
FIG. 5 is a perspective view of a switch unit having a female connector.

In FIGS. 1 and 5, a synthetic resin switch unit main body 22 includes a female connector (the other connector) 24 on a vertical back wall 23 at the side of the door inner panel 1. On the verge of opening of the female connector 24, a taper guide 25 is formed for aligning the male connector 5. A male terminal 27 is provided inside a receiving chamber 26 extending to the taper guide 25.

A pressure contact wall 28 vertically extends from the back wall 23 downward. The pressure contact wall 28 is brought into contact with the connecting arm 16 of the lever 6. A hook 29 for hooking the connecting arm 16 protrudes horizontally from the pressure contact wall 28 at the bottom. Movement of the hook 29 pivots the lever 6 when joining or separating connectors.

Switches 31 and 32 on the switch unit 3 are pressed to drive a power window motor and rearview mirrors. The female connector 24 collectively connects the switch circuits to the male connector 5 on the side of the door inner panel 1 (see FIG. 1).

In FIG. 1, the door trimpanel 2 is not joined to the door inner panel 1, and the male and female connectors 5 and 24 are not connected to each other. The male connector 5 on the side of the door inner panel 1 is inserted into the bracket 8, while the following pins 7 are situated at the deep end of the guide slots 13. The lever 6 is supported by the following pins 7, and the supporting shaft 14, and protrudes toward the door trim panel 2. The connecting arm 16 of the lever 6 is brought into contact with the pressure contact wall 28 of the switch unit 3, and becomes hooked by the hook 29.

The door trim panel 2 is moved in the horizontal direction by a hook (not shown) at the upper end of the door trim panel 2 hooking the upper end of the door inner panel 1. By pushing the door trim panel 2 toward the door inner panel 1 in the horizontal direction in FIG. 1, the door trim panel 2 is fixed to the door inner panel 1 by a clip (not shown).

Figure 2:
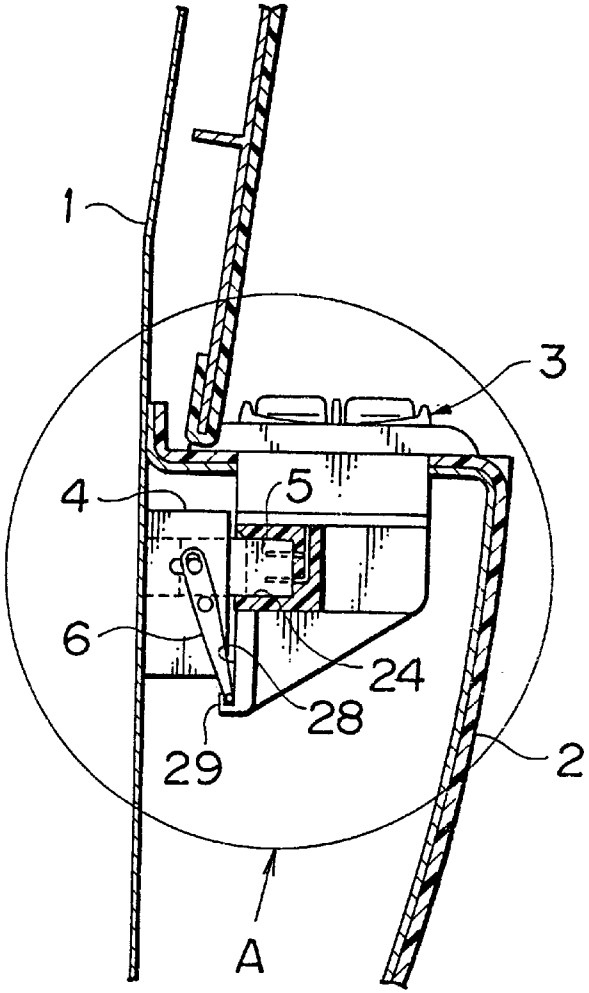
FIG. 2 is a side view of connectors engaged with each other.
Figure 3:
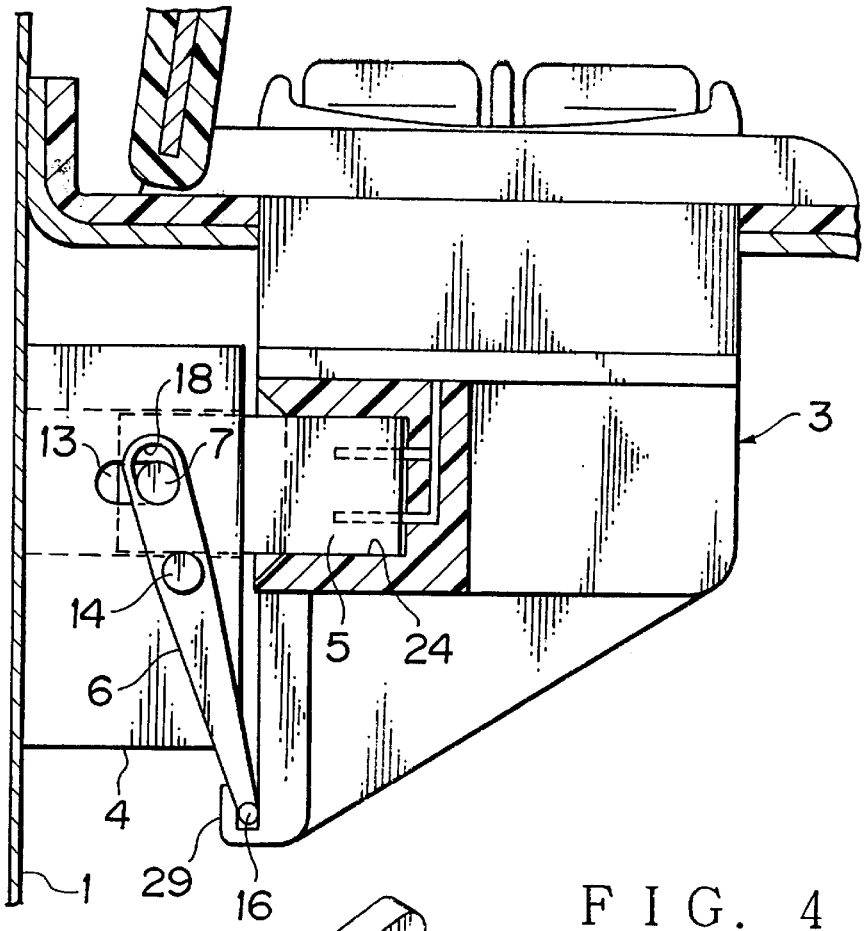
FIG. 3 is an enlarged view of A shown in FIG. 2.

FIGS. 2 and 3 (an enlarged view of A of FIG. 2) show the door trim panel 2 pushed toward the door inner panel. The pressure contact wall 28 of the switch unit 3 presses the lever 6 to pivot it clockwise, as shown by an arrow B in FIG. 1. By doing so, the male connector 5 protrudes forward from the bracket 4 and engages the female connector 24. Only a small pushing force is required for pushing the door trim panel 2 because of the leverage. If the lever 6 is positioned facing upward, it rotates counterclockwise. In such case, the hook 29 is provided at the upper side of the female connector 24.

The following pins 7 situated at the deep end of the guide slots 13 move toward the front end of the guide slots 13, as shown in FIGS. 2 and 3. As the lever 6 moves toward the vertical position, the following pins 7 approach the bottom end of the slide slots 18. The connecting arm 16 of the lever 6 slides downward along the pressure contact wall 28 to engage the hook 29.

Figure 7:
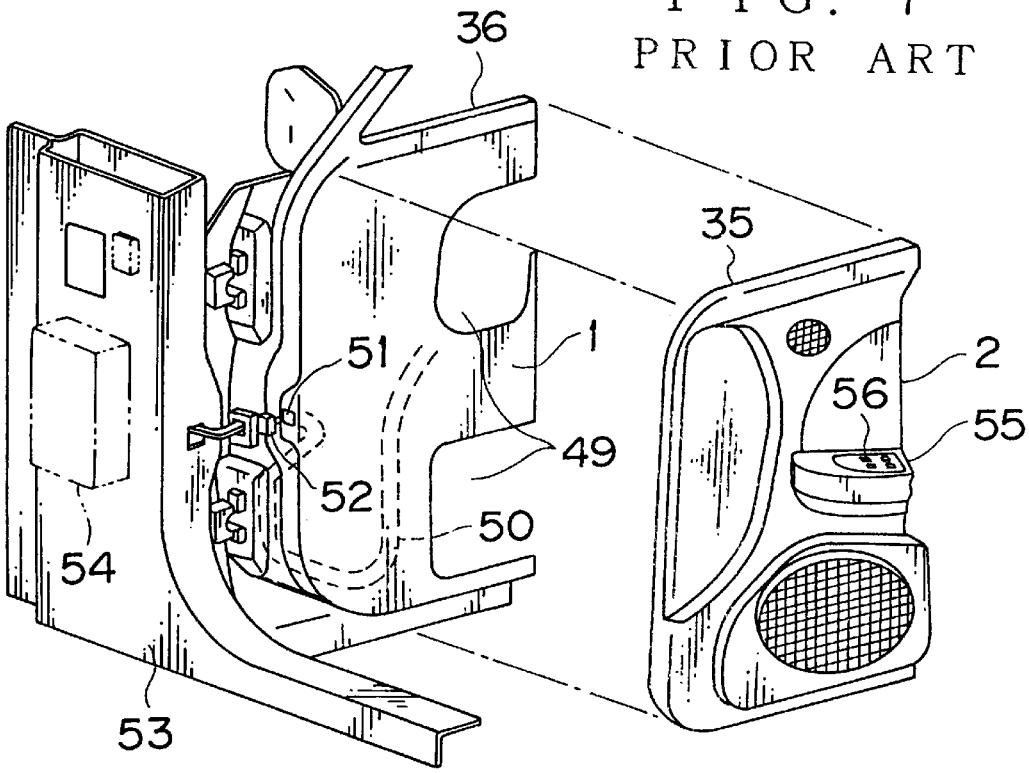
FIG. 7 PRIOR ART
FIG. 7 is an exploded perspective view of a door trim panel to be connected to a door inner panel.
Figure 6:
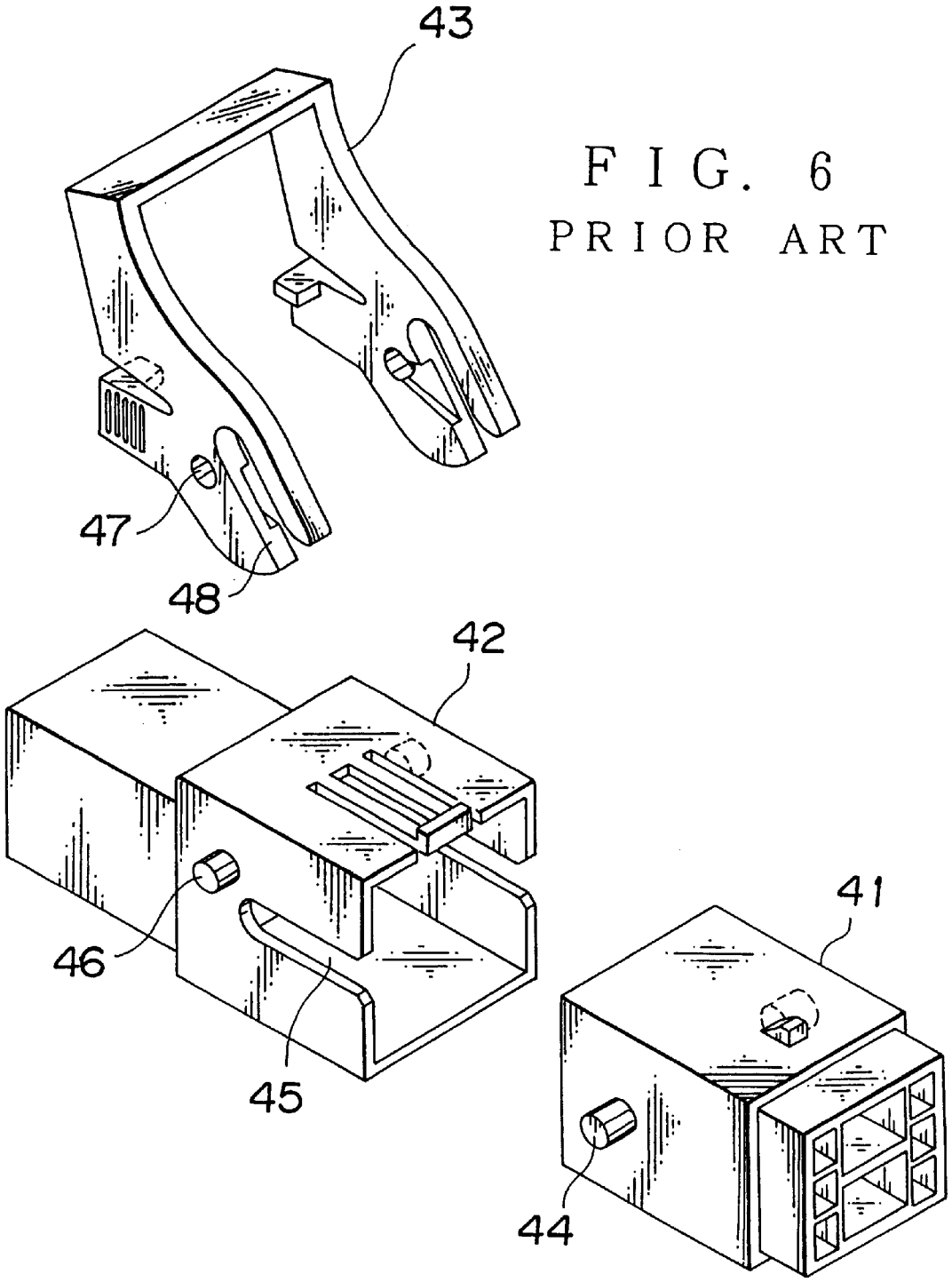
FIG. 6 PRIOR ART
FIG. 6 is an exploded perspective view of the prior art.

In this condition, the door trim panel 2 is separated from the door inner panel 1, with the upper end 36 (shown in FIG. 7) being the supporting point. Here, the hook 29 moves the lever 6 counterclockwise. Thus, the male connector 5 can be easily disconnected from the female connector 24. The hook 29 unhooks the connecting arm 16 of the lever 16 so as to release the door trim panel 2.

As described so far, according to the present invention, connectors can be connected to each other at the same time of joining a door trim panel to a door inner panel, and the connectors can be disconnected from each other at the same time of separating the door trim panel from the door inner panel. Thus, the conventional manual operation used in connecting connectors becomes unnecessary, and the connector connecting operation and separating operation can be facilitated. The number of operation stages can also be reduced. Especially when engaging the connectors, the present invention is effective because the engaging force is made up of a pressing force of the door trim panel toward the door inner panel and the pressing force of the lever toward the engaging point. The present invention also eliminates the extra length required for the wire in the conventional connector connecting operation using a door harness. Thus, the wiring of the wire harness according to the present invention can be simpler than in the prior art.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A connector connecting structure for connecting a first connector mounted on a first panel to a mating second connector mounted on a second panel comprising:

a frame wall fixed to said first panel and operative to slidably mount said first connector;

following pins mounted on said first connector and positioned to extend through guide slots in said frame wall;

a pressure contact wall mounted on a second panel on which said mating second connector is mounted; and a lever being mounted by supporting shafts on said frame wall, said lever having slide slots engaging said following pins whereby said first connector is connected with said mating second connector by moving said lever by engagement with said second panel to move said first connector by cooperation between said following pins and said slide slots.

2. A connector connecting structure according to claim 1, wherein said pressure contact wall is provided with a hook for hooking said lever.

3. A connector connecting structure according to claim 2, wherein said first connector is slidable in a horizontal direction, said pressure contact wall extends perpendicularly to the horizontal direction with respect to said hook, and said first and second panels are moved in the horizontal direction so as to join said panels and push said lever to pivot for connecting said first connector with said mating second connector.

4. A connector connecting structure according to claim 3, wherein said lever is pivotally supported by a supporting shaft at its base portion.

5. A connector connecting structure according to claim 4, wherein said lever includes a pair of side arms and a connecting arm which connects the pair of side arms.

6. A connector connecting structure according to claim 5, wherein a length between said supporting shaft and said connecting arm is longer than a length between said supporting shaft and said following pins to provide leverage for said lever.

* * * * *